US011538386B1

(12) United States Patent
Li et al.

(10) Patent No.: US 11,538,386 B1
(45) Date of Patent: Dec. 27, 2022

(54) REFERENCE VOLTAGE GENERATION CIRCUIT AND ITS GENERATION METHOD, DISPLAY DEVICE

(71) Applicant: TCL CHINA STAR OPTOELECTRONICS TECHNOLOGY CO., LTD., Guangdong (CN)

(72) Inventors: Haoran Li, Guangdong (CN); Jianfeng Xiao, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 17/429,337

(22) PCT Filed: Jul. 27, 2021

(86) PCT No.: PCT/CN2021/108648
§ 371 (c)(1),
(2) Date: Aug. 8, 2021

(30) Foreign Application Priority Data

Jun. 24, 2021 (CN) ..... 2021107059326.6

(51) Int. Cl.
*G09G 3/20* (2006.01)

(52) U.S. Cl.
CPC ..... *G09G 3/20* (2013.01); *G09G 2310/0291* (2013.01); *G09G 2330/021* (2013.01); *G09G 2330/028* (2013.01); *G09G 2330/045* (2013.01)

(58) Field of Classification Search
CPC ..... G09G 3/3607; G09G 3/3688
See application file for complete search history.

(56) References Cited

U.S. PATENT DOCUMENTS 9,024,913 B1 * 5/2015 Jung ..... G09G 3/3655 345/174
2010/0321361 A1 12/2010 Weng
2017/0178587 A1 * 6/2017 Jin ..... G09G 3/3696
2021/0097939 A1 * 4/2021 Chae ..... G09G 3/3225
2021/0335315 A1 * 10/2021 Zhang ..... G09G 3/3696

FOREIGN PATENT DOCUMENTS

CN 105471049 A 4/2016
CN 109087483 A 12/2018

* cited by examiner

*Primary Examiner* — Van N Chow
(74) *Attorney, Agent, or Firm* — Mark M. Friedman

(57) ABSTRACT

A reference voltage generation circuit is provided. The reference voltage generation circuit reduces a potential difference between a reference voltage less than a first data driving voltage and a data driving voltage, namely, the potential difference between a lower reference voltage and the data driving voltage is reduced. Therefore, the power loss of a voltage dividing module is reduced to prevent the problems of reduced reliability and reduced service life of a drive circuit board due to excessive internal temperature.

14 Claims, 3 Drawing Sheets

REFERENCE VOLTAGE GENERATION CIRCUIT AND ITS GENERATION METHOD, DISPLAY DEVICE

TECHNICAL FIELD

The present disclosure relates to a field of display technology, and more particularly to a reference voltage generation circuit, a reference voltage generation method, and a display device.

BACKGROUND

Currently, a drive circuit board of the display panel integrates a power management integrated circuit (PM IC), a gamma correction chip (GAMMA IC), and a level shift circuit. The PM IC is used to generate a data drive voltage (AVDD voltage), a common voltage (VCOM voltage), a gate low voltage (VGL voltage), and a gate high voltage (VGH voltage), where the VCOM voltage is generated by the AVDD voltage. The GAMMA IC generates a plurality groups of GAMMA voltages under action of the AVDD voltage.

First, the VCOM voltage includes a plurality of types, such as a color filter substrate common voltage (CF VCOM), an array substrate common voltage (AVCOM) and so on, wherein, the AVCOM may be greater than the benchmark voltage Vin or lower than the benchmark voltage Vin, but the CF VCOM voltage is generally lower than the benchmark voltage Vin. Secondly, one part of the GAMMA voltage is greater than the benchmark voltage Vin, and another part of the GAMMA voltage is lower than the benchmark voltage Vin, namely, since a plurality of VCOM voltages and the plurality groups of GAMMA voltages may be greater than the benchmark voltage Vin or lower than the benchmark voltage Vin. Therefore, the benchmark voltage Vin is generally raised to the AVDD voltage through a boost circuit, and then the AVDD voltage is divided by series resistors to obtain a variety of VCOM voltages and the plurality groups of GAMMA voltages.

FIG. 1 is a circuit diagram of a reference voltage generation circuit provided in conventional technology. As shown in FIG. 1, the reference voltage includes the VCOM voltage and the GAMMA voltage. The reference voltage generation circuit 10 in the conventional technology mainly includes three parts: an power supply sub-circuit 101, a boost sub-circuit 102, and a voltage divider sub-circuit 103 connected in sequence. First, the power supply sub-circuit 101 provides the benchmark voltage Vin to the voltage boosting sub-circuit 102, then the voltage boosting sub-circuit 102 boosts the benchmark voltage Vin to the data driving voltage AVDD, and finally, the voltage dividing sub-circuit 103 divides the data driving voltage AVDD into the plurality of VCOM voltages and the plurality groups of GAMMA voltages. However, since the data driving voltage AVDD is greater than the benchmark voltage Vin, therefore, for the VCOM voltage and the GAMMA voltage that are much lower than the benchmark voltage Vin, the potential difference between the data driving voltage AVDD and the VCOM voltage and the GAMMA voltage that are much lower than the benchmark voltage Vin is relatively large, so that the pressure of the voltage dividing sub-circuit 103 is relatively large, and the power loss of the voltage dividing sub-circuit 103 is relatively large. The drive circuit board itself is highly integrated and power consumption is concentrated, so this inevitably leads to an excessively high temperature inside the drive circuit board, which reduces the reliability of the drive circuit board and thus reduces the service life of the drive circuit board.

Therefore, there is an urgent need to provide a new reference voltage generation circuit including a common voltage and a gamma voltage to solve the problem of large power loss caused by the large potential difference between the data driving voltage AVDD and the reference voltage far lower than the benchmark voltage Vin in the reference voltage generation circuit of the conventional technology.

SUMMARY

In order to solve the above-mentioned problems, embodiments of the present disclosure provide a reference voltage generation circuit, a reference voltage generation method, and a display device.

In a first aspect, the embodiments of the present disclosure provide a reference voltage generation circuit, and the reference voltage generation circuit includes a power supply module, a transformer module and a voltage dividing module connected in sequence; wherein, The power supply module is configured to provide a benchmark voltage;

The transformer module is configured to provide a first data driving voltage according to the benchmark voltage, and the first data driving voltage is less than the benchmark voltage; and The voltage dividing module is configured to generate a reference voltage less than the first data driving voltage according to the first data driving voltage.

In some embodiments, the transformer module is further configured to provide a second data driving voltage according to the benchmark voltage, and the second data driving voltage is greater than the benchmark voltage; and the voltage dividing module is further configured to generate the reference voltage not less than the first data driving voltage according to the second data driving voltage.

In some embodiments, the voltage dividing module includes a voltage boosting unit and a voltage dropping unit connected in parallel, the voltage boosting unit is configured to generate the first data driving voltage according to the benchmark voltage, and the voltage dropping unit is configured to generate the second data driving voltage according to the benchmark voltage.

In some embodiments, the voltage dividing module includes a plurality of resistors connected in series, and the voltage dividing module divides the first data driving voltage and/or the second data driving voltage through the plurality of resistors connected in series to generate the reference voltage.

In some embodiments, the reference voltage generation circuit further includes a buffer module, the buffer module is connected with the voltage dividing module, and the buffer module is configured to buffer and output the reference voltage generated by the voltage dividing module.

In some embodiments, the reference voltage includes a common voltage and/or a gamma voltage.

In a second aspect, the embodiments of the present disclosure provide a reference voltage generation method, the reference voltage generation method includes:

Providing a benchmark voltage through a power supply module;

Converting the benchmark voltage into a first data driving voltage through a transformer module, and the first data driving voltage is less than the benchmark voltage; and Generating a reference voltage less than the first data driving voltage according the first data driving voltage through a voltage dividing module.

In some embodiments, the reference voltage generation method further includes:

Converting the benchmark voltage into a second data driving voltage through the transformer module, and the second data driving voltage greater than the benchmark voltage; and Generating the reference voltage not less than the first data driving voltage according to the second data driving voltage through the voltage dividing module.

In some embodiments, the voltage dividing module includes a voltage boosting unit and a voltage dropping unit connected in parallel; the step of converting the benchmark voltage into the first data driving voltage and the second data driving voltage includes:

Decreasing the benchmark voltage to the first data driving voltage through the voltage dropping unit; and Raising the benchmark voltage to the second data driving voltage through the voltage boosting unit.

In some embodiments, the voltage dividing module includes a plurality of resistors connected in series; the step of generating the reference voltage not less than the first data driving voltage according to the second data driving voltage, and the step of generating the reference voltage less than the first data driving voltage according the first data driving voltage includes:

Dividing the second data driving voltage to obtain the reference voltage greater than the first data driving voltage through the plurality of resistors connected in series; and Dividing the first data driving voltage to obtain the reference voltage not greater than the first data driving voltage through the plurality of resistors connected in series.

In some embodiments, the reference voltage generation method further includes: buffering and outputting the reference voltage generated by the voltage dividing module through a buffer module.

In a third aspect, the embodiments of the present disclosure provide a display device, the display device includes a power supply module, a transformer module and a voltage dividing module connected in sequence; wherein, The power supply module is configured to provide a benchmark voltage;

The transformer module is configured to provide a first data driving voltage according to the benchmark voltage, and the first data driving voltage is less than the benchmark voltage; and The voltage dividing module is configured to generate a reference voltage less than the first data driving voltage according to the first data driving voltage.

In some embodiments, the transformer module is further configured to provide a second data driving voltage according to the benchmark voltage, and the second data driving voltage is greater than the benchmark voltage; and the voltage dividing module is further configured to generate the reference voltage not less than the first data driving voltage according to the second data driving voltage.

In some embodiments, the voltage dividing module includes a voltage boosting unit and a voltage dropping unit connected in parallel, the voltage boosting unit is configured to generate the first data driving voltage according to the benchmark voltage, and the voltage dropping unit is configured to generate the second data driving voltage according to the benchmark voltage.

In some embodiments, the voltage dividing module includes a plurality of resistors connected in series, and the voltage dividing module divides the first data driving voltage and/or the second data driving voltage through the plurality of resistors connected in series to generate the reference voltage.

In some embodiments, the display device further includes a buffer module, the buffer module is connected with the voltage dividing module, and the buffer module is configured to buffer and output the reference voltage generated by the voltage dividing module.

In some embodiments, the reference voltage includes a common voltage and/or a gamma voltage.

In the reference voltage generation circuit and the reference voltage generation method provided by the embodiments of the present disclosure, the reference voltage generation circuit includes a power supply module, a transformer module, and a voltage dividing module connected in sequence. First, the power supply module provides the benchmark voltage, then the transformer module steps down the benchmark voltage to the first data driving voltage, and finally the voltage dividing module generates the reference voltage less than the first data driving voltage according to the first data driving voltage, so that the reference voltage less than the first data driving voltage is generated only by the first data driving voltage. This reduces the potential difference between the reference voltage that is lower than the first data driving voltage and the data driving voltage compared with that all reference voltages in the conventional technology need to be generated from a greater data driving voltage. Namely, the potential difference between the lower reference voltage and the data driving voltage is reduced. Therefore, the power loss of the voltage dividing module is reduced to prevent the problems of reduced reliability and reduced service life of the drive circuit board due to excessive internal temperature.

DETAILED DESCRIPTION OF PREFERRED EMBODIMENTS

In order to make a purpose, technical solutions, and effects of the present disclosure clearer, hereinafter, the embodiments of the present disclosure will be described in detail with reference to the drawings. It should be understood that the specific embodiments described here are only used to explain the present disclosure, and are not used to limit the present disclosure.

It should be noted that the various types of voltage data in the embodiments of the present disclosure do not consider the polarity of the voltage, and the absolute value of the voltage data is used as an example for description.

Figure 1:
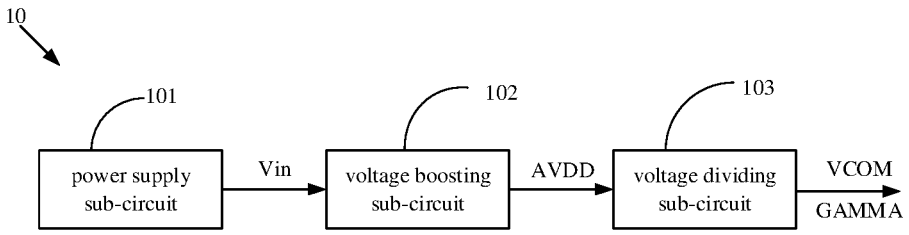
FIG. 1 is a circuit diagram of a reference voltage generation circuit provided in conventional technology.

Referring to FIG. 1, in conventional technology, A common voltage VCOM and a gamma voltage GAMMA are both obtained by dividing an unified data driving voltage AVDD. For example, suppose that a current I' in ae generation circuit is 20 mA, a benchmark voltage Vin' provided by an power supply sub-circuit 101 is 12V, a data driving voltage AVDD output by the voltage boosting sub-circuit 102 is 16V, and a CF VCOM voltage output by a voltage dividing sub-circuit 103 is 6.2V, then the power loss of the voltage dividing sub-circuit 103 $\Delta P'=\Delta UI'=(AVDD-CF\ VCOM)*I'=(16V-6.2V)*20\ mA=196\ mW$. At this time, an output power of the voltage dividing sub-circuit 103 is $P'=CF\ VCOM*I'=6.2V*20\ mA=124\ mW$, efficiency of the voltage divider circuit 103 is $\eta 2'=P'/(P'+\Delta P')=124/(196+124)=0.388$, and the total efficiency of the generating circuit is $\eta=\eta 1'*\eta 2'=0.85*0.388=32.9\%$, wherein, the $\eta 1'$ is the efficiency of the boost sub-circuit 102, and is set to a fixed value of 0.85.

Figure 2:
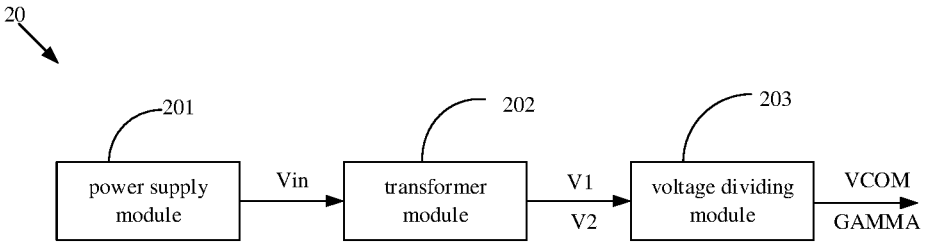
FIG. 2 is a circuit diagram of the reference voltage generation circuit provided by an embodiment of the present disclosure.

FIG. 2 is a circuit diagram of the reference voltage generation circuit provided by an embodiment of the present disclosure. The reference voltage generation circuit 20 provided by the embodiment of the present disclosure includes a power supply module 201, a transformer module 202 and a voltage dividing module 203 connected in sequence, wherein:

The power supply module 201 is configured to provide a benchmark voltage Vin;

The transformer module 202 is configured to provide a first data driving voltage V1 according to the benchmark voltage, and the first data driving voltage V1 is less than the benchmark voltage Vin; and The voltage dividing module 203 is configured to generate a reference voltage less than the first data driving voltage V1 according to the first data driving voltage V1.

The reference voltage generation circuit provided by the embodiment of the present disclosure includes the power supply module 201, the transformer module 202, and the voltage dividing module 203 connected in sequence, the reference voltage generation circuit first provides the benchmark voltage Vin from the power supply module 201, then the transformer module 202 steps down the benchmark voltage Vin to the first data driving voltage V1, and finally the voltage dividing module 203 generates the reference voltage less than the first data driving voltage V1 according to the first data driving voltage V1, so that the reference voltage less than the first data driving voltage V1 is generated only by the first data driving voltage V1. Therefore, the potential difference between the lower reference voltage and the data driving voltage is reduced, and the power loss of the voltage dividing module 203 is reduced to prevent the problems of reduced reliability and reduced service life of the drive circuit board due to excessive internal temperature.

Further, the transformer module 202 is further configured to provide a second data driving voltage V2 according to the benchmark voltage Vin, and the second data driving voltage V2 is greater than the benchmark voltage Vin; and the voltage dividing module 203 is further configured to generate the reference voltage not less than the first data driving voltage V1 according to the second data driving voltage V2.

Namely, the reference voltage generation circuit provided by the embodiment of the present disclosure is also configured to boost the benchmark voltage Vin to the second data driving voltage V2 through the voltage transformer module 202, then the voltage dividing module 203 generates the reference voltage not less than the first data driving voltage V1 according to the second data driving voltage V2. Therefore, the reference voltage not less than the first data driving voltage V1 is generated from the second data driving voltage V2, and the reference voltage that is less than the first data driving voltage V1 is generated only by the first data driving voltage V1 and not by the second data driving voltage V2. In this way, compared with the conventional technology, all reference voltages are generated by the second data driving voltage V2, so that a reference voltage less than the first data driving voltage V1 will have a larger potential difference with the second data driving voltage V2, and the power consumption of the voltage dividing module 203 is relatively large, according to the reference voltage generation circuit provided in the embodiment of the present disclosure, the voltage difference between the reference voltage less than the first data driving voltage V1 and the first data driving voltage V1 is much less than the voltage difference between the second data driving voltage V2 and the second data driving voltage V2, and the power consumption of the voltage dividing module 203 is greatly reduced.

It should be noted that the reference voltage includes the common voltage VCOM and the gamma voltage GAMMA. Wherein, the common voltage VCOM includes an array substrate common voltage AVCOM and a color film substrate common voltage CF VCOM.

For example, assuming that a current I in the reference voltage generation circuit is 20 mA, the benchmark voltage Vin provided by the power supply module 201 is 12V, the second data driving voltage V2 output by the transformer module 202 is 16V, and the first data driving voltage V1 is 6.5V. The CF VCOM voltage output by the voltage dividing module 203 is 6.2V, wherein, because the CF VCOM voltage is lower than the first data driving voltage V1, the CF VCOM voltage is generated according to the first data driving voltage V1 but not according to the second data driving voltage V2, then the power loss of the voltage dividing module 203 $\Delta P=\Delta UI=(V1-CF\ VCOM)*I=(6.5V-6.2V)*20\ mA=6\ mW$, and the output power of the voltage dividing module 203 $P=CF\ VCOM*I=6.2V*20\ mA=124\ mW$. According to the circuit efficiency=output power/input power, the efficiency of the voltage divider 203 $\eta 2=P/(P+\Delta P)=124/(6+124)=0.954$, then the total efficiency of the reference voltage generation circuit $\eta=\eta 1*\eta 2=0.85*0.388=81\%>32.9\%$, wherein, $\eta 1$ is the efficiency of the transformer module 202, which is set to a fixed value of 0.85. Therefore, the generation circuit provided by the embodiments of the present disclosure generate the common voltage VCOM, which is less than the first data driving voltage V1, from the first data driving voltage V1 but not the second data driving voltage V2, namely, the common voltage VCOM that is less than the first data driving voltage V1 can be selectively generated by a data driving voltage lower than that in the conventional technology, thereby increasing the efficiency of the voltage dividing module 203 and improving the overall efficiency of the circuit.

Figure 3:
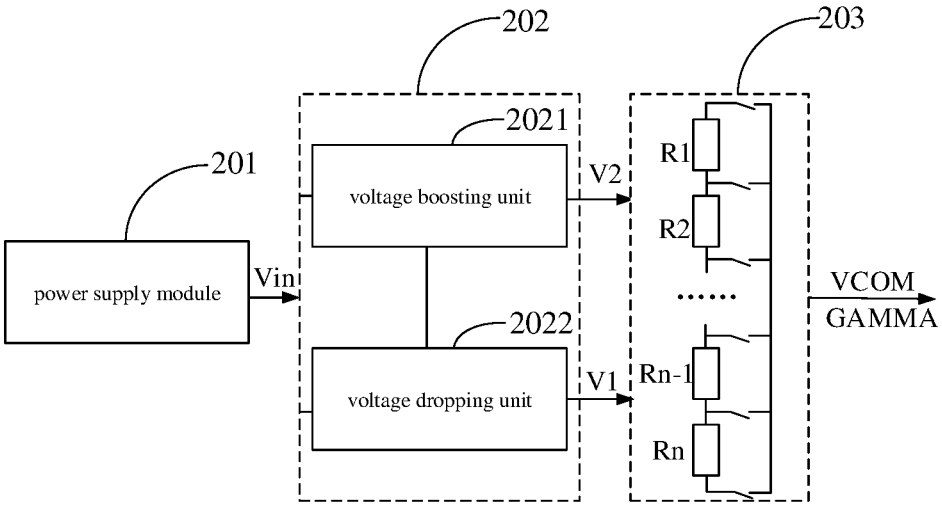
FIG. 3 is a specific circuit diagram of the reference voltage generation circuit provided by an embodiment of the present disclosure.

FIG. 3 is a specific circuit diagram of the reference voltage generation circuit provided by an embodiment of the present disclosure. As shown in FIG. 3, the transformer module 202 includes a voltage boosting unit 2021 and a voltage dropping unit 2022 connected in parallel, wherein, the boosting unit 2021 is configured to generate the second data driving voltage V2 according to the benchmark voltage Vin, and the voltage dropping unit 2022 is configured to generate the first data driving voltage V1 according to the benchmark voltage Vin. It is understood that the boost unit 2021 adopts a boost circuit, and the step-down unit 2022 adopts a buck circuit, and the transformer module 202 adopts a boost-buck circuit through the voltage boosting unit 2021 and the voltage dropping unit 2022 connected in parallel.

Please continue to refer to FIG. 3, the voltage dividing module 203 includes a plurality of resistors R1 to Rn connected in series (n is a positive integer). The voltage dividing module 203 divides the second data driving voltage V2 and/or the first data driving voltage V1 through the plurality of resistors R1 to Rn connected in series to generate the reference voltage, such as the common voltage VCOM and the gamma voltage GAMMA. Namely, each series resistance R1~Rn is controlled by a corresponding switch S. The voltage dividing module 203 divides the second data driving voltage V2 or the first data driving voltage V1 by selecting different numbers of series resistors R from the plurality of series resistors R1 to Rn, thereby generating different reference voltages according to the second data driving voltage V2 or the first data driving voltage V1, such as the plurality of common voltages VCOM or the plurality of gamma voltages GAMMA. It should be noted that the resistance value of the series resistors R1 to Rn can be same or different, and the resistance value of each series resistance can be set according to actual needs.

Figure 4:
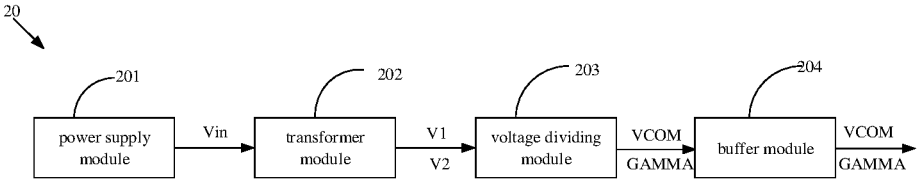
FIG. 4 is another circuit diagram of the reference voltage generation circuit provided by an embodiment of the present disclosure.

FIG. 4 is another circuit diagram of the reference voltage generation circuit provided by an embodiment of the present disclosure. Referring to FIG. 4, the reference voltage generation circuit further includes the buffer module 204, the buffer module 204 is connected with the voltage dividing module 203, and the buffer module 204 is configured to buffer and output the reference voltage generated by the voltage dividing module 203.

In some embodiments, the ratio of the first data driving voltage V1 to the second data driving voltage V2 is not greater than 0.5, namely, the first data driving voltage V1 is not greater than half of the second data driving voltage V2, so as to increase the potential difference between the second data driving voltage V2 and the first data driving voltage V1. Therefore, the second data driving voltage V2 or the first data driving voltage V1 can be flexibly selected according to the reference voltage to be generated, and the potential difference between the reference voltage and the data driving voltage is reduced.

For example, suppose that the reference voltage generation circuit needs to generate 14 gamma voltage GAMMA: GAMMA1=15V, GAMMA2=14V, GAMMA3=13V, GAMMA4=12V, GAMMA5=11V, GAMMA6=10V, GAMMA7=9V, GAMMA8=7V, GAMMA9=6V, GAMMA10=5V, GAMMA11=4V, GAMMA12=3V, GAMMA13=2V, GAMMA14=1V.

On condition that the reference voltage generation circuit of the conventional technology shown in FIG. 1 is adopted, and assuming that the benchmark voltage Vin' provided by the power supply sub-circuit 101 is 12V, the data driving voltage AVDD output by the voltage boosting sub-circuit 102 is 16V, then the input power of the voltage dividing sub-circuit 103 is P1'=AVDD*I0', wherein, I0' is the total current of the voltage divider circuit 103. On condition that each gamma voltage GAMMA is generated as a branch, and the current I' of each gamma voltage GAMMA branch is 10 mA, then 14 parallel branches are required to generate 14 gamma voltage GAMMA. At this time, I1'=14*I'=14*10 mA=140 mA, P1'=AVDD*I0'=16V*140 mA=2240 mW, the output power of the voltage dividing sub-circuit 103 is P'=(GAMMA1+GAMMA2+GAMMA3+ . . . +GAMMA14)*I'=(15+14+13+12+11+10+9+7+6+5+4+3+2+1) V*10 mA=1120 mW, and the efficiency of the voltage divider circuit 103 η2'=P'/P1'=1120/2240=0.5, then the total efficiency of the generation circuit η'=η1'*η2'=0.85* 0.5=42.5%, wherein the η1 is the efficiency of the boost sub-circuit 102, which is set to the fixed value of 0.85.

Figure 5:
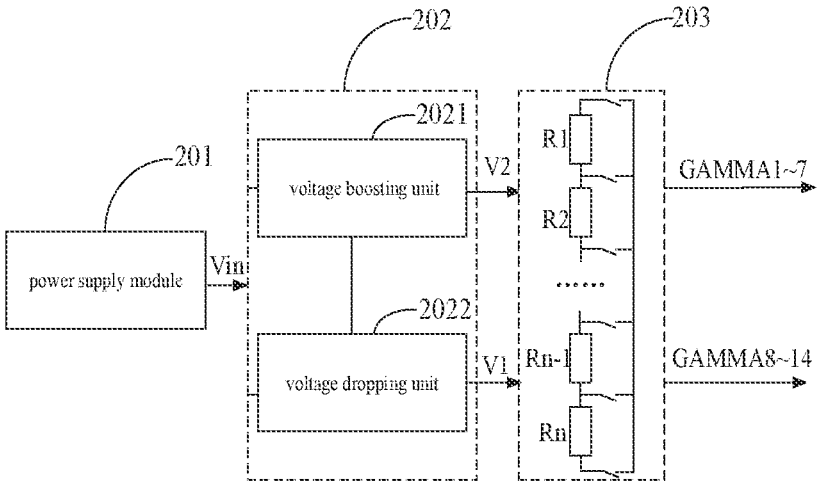
FIG. 5 is a circuit diagram for generating a gamma voltage by the reference voltage generation circuit provided by an embodiment of the present disclosure.

On condition that the reference voltage generation circuit provided by the embodiment of the present disclosure shown in FIG. 2 is adopted, referring to FIG. 5, the circuit diagram for generating the gamma voltage by the reference voltage generation circuit is provided by an embodiment of the present disclosure. Assuming that the benchmark voltage Vin provided by the power supply module 201 is 12V, the second data driving voltage V2 output by the transformer module 202 is 16V, and the second data driving voltage V1 is 8V, then GAMMA1~GAMMA7 are generated by the second data driving voltage V2, and GAMMA8~GAMMA14 are generated by the first data driving voltage V1. Similarly, On condition that the current of each branch of the gamma voltage GAMMA is 10 mA, and according to the input power of the voltage divider 203 P1=V2*I01+V1*I02, wherein, the I01 is the total current of the GAMMA branch GAMMA1~GAMMA7 corresponding to the gamma voltage of the boost unit 2021 in the voltage dividing module 203, and the I02 is the total current of the gamma branch GAMMA8~GAMMA14 in the voltage dividing module 203 corresponding to the step-down unit 2022, namely, the I01 and the I02 are both 70 mA, Obtain P1=V2*I01+V1*I02=16V*70 mA+8V*70 mA=1120 mW+560 mW=1680 mW. At this time, the output power of the voltage dividing module 203 P=(GAMMA1+GAMMA2+GAMMA3+ . . . +GAMMA14)*I=(15+14+13+12+11+10+9+7+6+5+4+3+2+1) V*10 mA=1120 mW, and the efficiency of the voltage divider 203 η2=P/P1=1120/1680=0.67, then the total efficiency of the generating circuit η=η1*η2=0.85*0.67=56.7%>42.5%, wherein, η1 is the efficiency of the transformer module 202, which is set to the fixed value of 0.85. Namely, the efficiency η11 of the voltage boost unit 2021 and the efficiency η12 of the voltage dropping unit 2022 in the transformer module 202 are both 0.85. Therefore, in the generation circuit provided by the embodiments of the present disclosure, the gamma voltage GAMMA less than the first data driving voltage V1 is generated by the first data driving voltage V1, and the gamma voltage GAMMA not less than the first data driving voltage V1 is generated by the second data driving voltage V2. Namely, the gamma voltage GAMMA that is less than the first data driving voltage V1 can be selectively generated by the data driving voltage lower than that in the conventional technology, thereby increasing the efficiency of the voltage dividing module 203 and improving the overall efficiency of the circuit.

Figure 6:
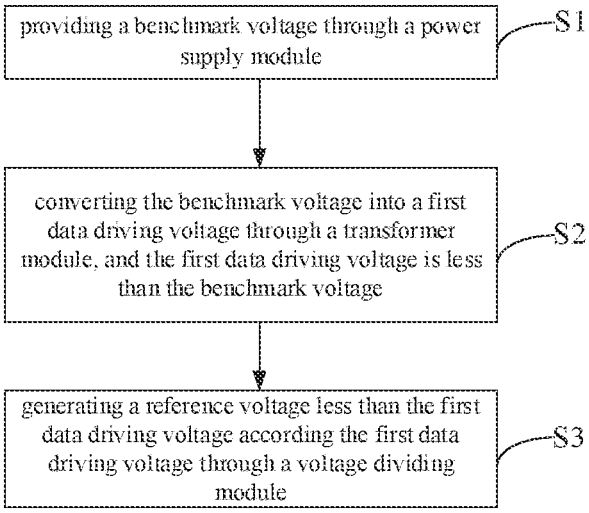
FIG. 6 is a schematic flowchart of a reference voltage generation method provided by an embodiment of the present disclosure.

Based on the above embodiment, FIG. 6 is a schematic flowchart of the reference voltage generation method provided by an embodiment of the present disclosure. Referring to FIG. 6, the reference voltage generation method includes:

S1, providing a benchmark voltage through a power supply module;

S2, converting the benchmark voltage into a first data driving voltage through a transformer module, and the first data driving voltage is less than the benchmark voltage; and S3, generating a reference voltage less than the first data driving voltage according the first data driving voltage through a voltage dividing module.

In the reference voltage generation method provided by the embodiment of the present disclosure, first, the power supply module 201 provides the benchmark voltage Vin, then the transformer module 202 steps down the benchmark voltage Vin to the first data driving voltage V1, and finally the voltage dividing module 203 generates the reference voltage less than the first data driving voltage V1 according to the first data driving voltage V1, so that the reference voltage less than the first data driving voltage V1 is generated only by the first data driving voltage V1. Therefore, the potential difference between the lower reference voltage and the data driving voltage is reduced, and the power loss of the voltage dividing module 203 is reduced to prevent the problems of reduced reliability and reduced service life of the drive circuit board due to excessive internal temperature.

Further, the reference voltage generation method further includes: converting the benchmark voltage Vin into the second data driving voltage V2 through the transformer module 202, and the second data driving voltage V2 greater than the benchmark voltage Vin; and generating the reference voltage not less than the first data driving voltage V1 according to the second data driving voltage V2 through the voltage dividing module 203.

Wherein, the voltage dividing module 202 includes the voltage boosting unit 2021 and the voltage dropping unit 2022 connected in parallel; the step of converting the benchmark voltage Vin into the first data driving voltage V1 and the second data driving voltage V2 includes: decreasing the benchmark voltage Vin to the first data driving voltage V1 through the voltage dropping unit 2022; and raising the benchmark voltage Vin to the second data driving voltage V2 through the voltage boosting unit 2021.

Wherein, the voltage dividing module 203 includes the plurality of resistors R1~Rn connected in series. The step of generating the reference voltage not less than the first data driving voltage V1 according to the second data driving voltage V2, and the step of generating the reference voltage less than the first data driving voltage V1 according the first data driving voltage V1 includes: dividing the second data driving voltage V2 to obtain the reference voltage greater than the first data driving voltage V1 through the plurality of resistors R1~Rn connected in series; and dividing the first data driving voltage V1 to obtain the reference voltage not greater than the first data driving voltage V1 through the plurality of resistors R1~Rn connected in series. Namely, The reference voltage not less than the first data driving voltage V1 is generated by the second data driving voltage V2, and the reference voltage less than the first data driving voltage V1 is only generated by the first data driving voltage.

Further, the reference voltage generation method further includes: buffering the reference voltage generated by the voltage dividing module 203 through the buffer module 204 and then outputting it, so as to stabilize the final output reference voltage.

Based on the foregoing embodiment, an embodiment of the present disclosure also provides a display device. The display device includes the reference voltage generation circuit as described above. The structure and beneficial effects of the display device and the reference voltage generation circuit are the same. Since the reference voltage generation circuit has been described in detail in the foregoing embodiment, it will not be repeated here.

In the reference voltage generation circuit, the reference voltage generation method, and the display device provided by the embodiments of the present disclosure, the reference voltage generation circuit includes the power supply module 201, the transformer module 202, and the voltage dividing module 203 connected in sequence, the reference voltage generation circuit first provides the benchmark voltage Vin from the power supply module 201. Then the voltage transformer module 202 boosts the benchmark voltage Vin to the second data driving voltage V2 and steps down the benchmark voltage Vin to the first data driving voltage V1. Finally, the voltage dividing module 203 generates the reference voltage not less than the first data driving voltage V1 according to the second data driving voltage V2, and generating the reference voltage less than the first data driving voltage V1 according to the first data driving voltage V1. So that the reference voltage less than the first data driving voltage V1 is generated only by the first data driving voltage V1 and not by the second data driving voltage V2. Therefore, the potential difference between the lower reference voltage and the data driving voltage is reduced, and the power loss of the voltage dividing module 203 is reduced to prevent the problems of reduced reliability and reduced service life of the drive circuit board due to excessive internal temperature. Wherein, the reference voltage includes the common voltage VCOM and/or the gamma voltage GAMMA.

It can be understood that for those of ordinary skill in the art, equivalent substitutions or changes can be made according to the technical solution and inventive concept of the present disclosure, and all these changes or substitutions should fall within the protection scope of the appended claims of the present disclosure.

What is claimed is:

1. A reference voltage generation circuit, comprising a power supply module, a transformer module and a voltage dividing module connected in sequence;

wherein the power supply module is configured to provide a benchmark voltage;

the transformer module is configured to provide a first data driving voltage according to the benchmark voltage, and the first data driving voltage is less than the benchmark voltage; and the voltage dividing module is configured to generate a reference voltage less than the first data driving voltage according to the first data driving voltage, and wherein the transformer module is further configured to provide a second data driving voltage according to the benchmark voltage, and the second data driving voltage is greater than the benchmark voltage; and the voltage dividing module is further configured to generate the reference voltage not less than the first data driving voltage according to the second data driving voltage.

2. The reference voltage generation circuit of claim 1, wherein the voltage dividing module comprises a voltage boosting unit and a voltage dropping unit connected in parallel, the voltage boosting unit is configured to generate the first data driving voltage according to the benchmark voltage, and the voltage dropping unit is configured to generate the second data driving voltage according to the benchmark voltage.

3. The reference voltage generation circuit of claim 1, wherein the voltage dividing module comprises a plurality of resistors connected in series, and the voltage dividing module divides the first data driving voltage and/or the second data driving voltage through the plurality of resistors connected in series to generate the reference voltage.

4. The reference voltage generation circuit of claim 1, wherein the reference voltage generation circuit further comprises a buffer module, the buffer module is connected with the voltage dividing module, and the buffer module is configured to buffer and output the reference voltage generated by the voltage dividing module.

5. The reference voltage generation circuit of claim 1, wherein the reference voltage comprises a common voltage and/or a gamma voltage.

6. A reference voltage generation method, comprising:

providing a benchmark voltage through a power supply module;

converting the benchmark voltage into a first data driving voltage through a transformer module, and the first data driving voltage is less than the benchmark voltage; and generating a reference voltage less than the first data driving voltage according the first data driving voltage through a voltage dividing module, and wherein the reference voltage generation method further comprises:

converting the benchmark voltage into a second data driving voltage through the transformer module, and the second data driving voltage greater than the benchmark voltage; and generating the reference voltage not less than the first data driving voltage according to the second data driving voltage through the voltage dividing module.

7. The reference voltage generation method of claim 6, wherein the voltage dividing module comprises a voltage boosting unit and a voltage dropping unit connected in parallel;

the step of converting the benchmark voltage into the first data driving voltage and the second data driving voltage comprises:

decreasing the benchmark voltage to the first data driving voltage through the voltage dropping unit; and raising the benchmark voltage to the second data driving voltage through the voltage boosting unit.

8. The reference voltage generation method of claim 6, wherein the voltage dividing module comprises a plurality of resistors connected in series;

the step of generating the reference voltage not less than the first data driving voltage according to the second data driving voltage, and the step of generating the reference voltage less than the first data driving voltage according the first data driving voltage comprises:

dividing the second data driving voltage to obtain the reference voltage not less than the first data driving voltage through the plurality of resistors connected in series; and dividing the first data driving voltage to obtain the reference voltage less than the first data driving voltage through the plurality of resistors connected in series.

9. The reference voltage generation method of claim 6, wherein the reference voltage generation method further comprises:

buffering and outputting the reference voltage generated by the voltage dividing module through a buffer module.

10. A display device, comprising a reference voltage generation circuit, wherein the reference voltage generation circuit comprises a power supply module, a transformer module and a voltage dividing module connected in sequence;

wherein the power supply module is configured to provide a benchmark voltage;

the transformer module is configured to provide a first data driving voltage according to the benchmark voltage, and the first data driving voltage is less than the benchmark voltage; and the voltage dividing module is configured to generate a reference voltage less than the first data driving voltage according to the first data driving voltage, and wherein the transformer module is further configured to provide a second data driving voltage according to the benchmark voltage, and the second data driving voltage is greater than the benchmark voltage; and the voltage dividing module is further configured to generate the reference voltage not less than the first data driving voltage according to the second data driving voltage.

11. The display device of claim 10, wherein the voltage dividing module comprises a voltage boosting unit and a voltage dropping unit connected in parallel, the voltage boosting unit is configured to generate the first data driving voltage according to the benchmark voltage, and the voltage dropping unit is configured to generate the second data driving voltage according to the benchmark voltage.

12. The display device of claim 10, wherein the voltage dividing module comprises a plurality of resistors connected in series, and the voltage dividing module divides the first data driving voltage and/or the second data driving voltage through the plurality of resistors connected in series to generate the reference voltage.

13. The display device of claim 10, wherein the display device further comprises a buffer module, the buffer module is connected with the voltage dividing module, and the buffer module is configured to buffer and output the reference voltage generated by the voltage dividing module.

14. The display device of claim 10, wherein the reference voltage comprises a common voltage and/or a gamma voltage.

* * * * *